US006945596B2

(12) United States Patent
Huang

(10) Patent No.: US 6,945,596 B2
(45) Date of Patent: Sep. 20, 2005

(54) RECLINING CHAIR WITH BACK AND FOOTREST ADJUSTABLE IN POSITION AT THE SAME TIME

(76) Inventor: Chi-Tzung Huang, No. 20, Industry 3rd Rd., Hsing Nan Vill., Min Hsiung, Chia Yi Hsien (TW)

( * ) Notice: Subject to any disclaimer, the term of this patent is extended or adjusted under 35 U.S.C. 154(b) by 68 days.

(21) Appl. No.: 10/751,424

(22) Filed: Jan. 6, 2004

(65) Prior Publication Data

US 2005/0179298 A1 Aug. 18, 2005

(51) Int. Cl.[7] ..... A47C 1/02
(52) U.S. Cl. ..... 297/68; 297/377; 297/463.1
(58) Field of Search ..... 297/68, 71, 73, 297/74, 75, 377, 463.1

(56) References Cited

U.S. PATENT DOCUMENTS 3,311,407 A * 3/1967 Hideharu ..... 297/71
3,980,335 A * 9/1976 Marhefka ..... 297/68
5,342,114 A * 8/1994 Burke et al. ..... 297/377
5,547,256 A * 8/1996 D'Antuono et al. ..... 297/377

* cited by examiner

*Primary Examiner*—Anthony D. Barfield
(74) *Attorney, Agent, or Firm*—Rosenberg, Klein & Lee

(57) ABSTRACT

A reclining chair, which has a back and a footrest both angularly displaceable relative to a seat simultaneously, is equipped with an adjusting mechanism, which includes a shaft, a pedal secured to one end of the shaft, a pushing member secured to the other end of the shaft, a fixed pin, and a locking rod; the locking rod is pivoted to the back at an upper end, and is right opposite the pushing member at a lower portion; the locking rod has engaging gaps on a rear edge for selective engagement with the pin; a spring is used for biasing the locking rod such that the locking rod can normally engage the pin at the gaps; thus, the footrest can be adjusted together with the back when the pedal is depressed for making the pushing member push the locking rod forwards such that the locking rod disengages the pin.

3 Claims, 6 Drawing Sheets

RECLINING CHAIR WITH BACK AND FOOTREST ADJUSTABLE IN POSITION AT THE SAME TIME

BACKGROUND OF THE INVENTION

1. Field of the Invention

The present invention relates to a reclining chair, more particularly one whose back and footrest can be angularly displaced relative to the seat at the same time for suiting the sitter's need.

2. Brief Description of the Prior Art

Referring to FIG. 1, a conventional reclining chair 1 includes a frame 12, and a footrest. The footrest is comprised of a footrest part 11, and a control mechanism, which includes a pivotal shaft 13 supported with the frame 12, a control pedal 14 joined to one end of the pivotal shaft 13, a co-moving block 15 fixed on the pivotal shaft 13, a first connecting rod 17 securely joined to one lateral side of the co-moving block 15, a second connecting rod 18 pivoted to the first connecting rod 17 at one end, and a third connecting rod 19, which is respectively pivoted to the footrest part 11, and the other end of the second connecting rod 18 at two ends thereof. In addition, the co-moving block 15 has a first rod 151 projecting out from it. And, a second rod 16 is securely connected with the frame 12 at one end, and connected with the first rod 151 at the other end. Thus, the footrest part 11 can be pivoted down to a substantially upright not-in-use position and raised to a stretched in-use one by means of operating the control pedal 14.

The above reclining chair is found to have disadvantages as followings:

1. The footrest part can only be held in the upright not-in-use position and the stretched in-use one, but cannot be adjusted in between for suiting the sitter's need in different situations. Therefore, the reclining chair is not ideal from ergonomic viewpoint.
2. The back of the reclining chair cannot be adjusted in position to suit the sitter's need, either. In other words, the reclining chair is not ideal from ergonomic viewpoint.

SUMMARY OF THE INVENTION

It is a main object of the present invention to provide a reclining chair to overcome the above disadvantages.

The reclining chair is equipped with an adjusting mechanism usable for adjusting a back and a footrest, which can be simultaneously angularly displaced relative to a seat supported on a frame. The adjusting mechanism includes a shaft on the frame, a pedal secured to one end of the shaft, a pushing member secured to the other end of the shaft, a fixed pin, and a locking rod for holding the back in position with. The locking rod is pivoted to the back at an upper end, and is right opposite a front side of the pushing member at a lower end. The locking rod has several spaced engaging gaps on a rear edge thereof for selective engagement with the pin. A spring is connected with the back and the locking rod at two ends for biasing the locking rod in such a way that the rod can normally engage the pin at the engaging gaps thereof. Thus, the back and the footrest are secured when the engaging pin is engaged with one of the engaging gaps, and the footrest can be adjusted together with the back when the pedal is depressed such that the pushing member pushes the locking rod forwards, and the locking rod disengages the pin.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
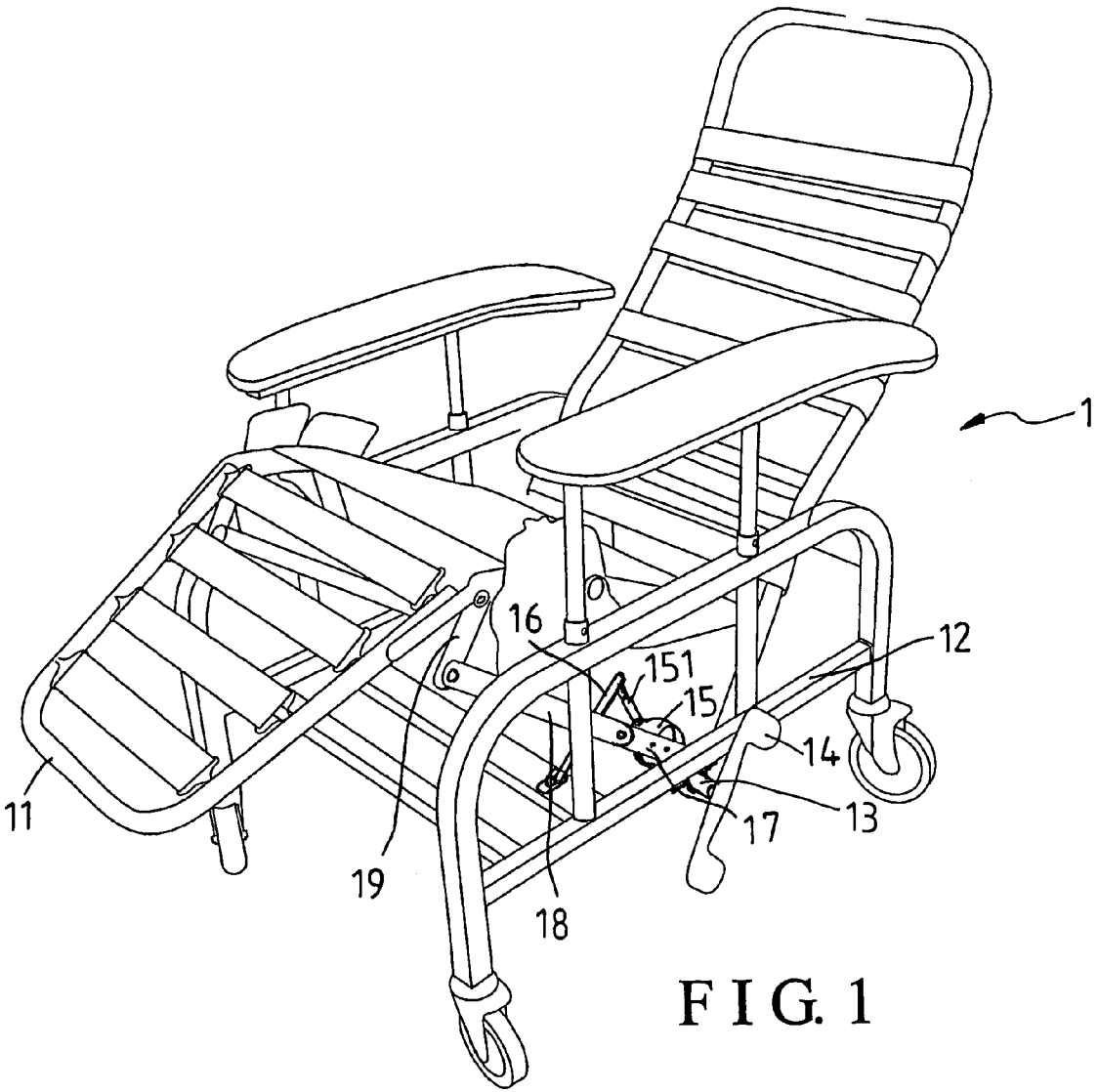
FIG. 1 is a perspective view of the conventional reclining chair as described in the Background.
Figure 2:
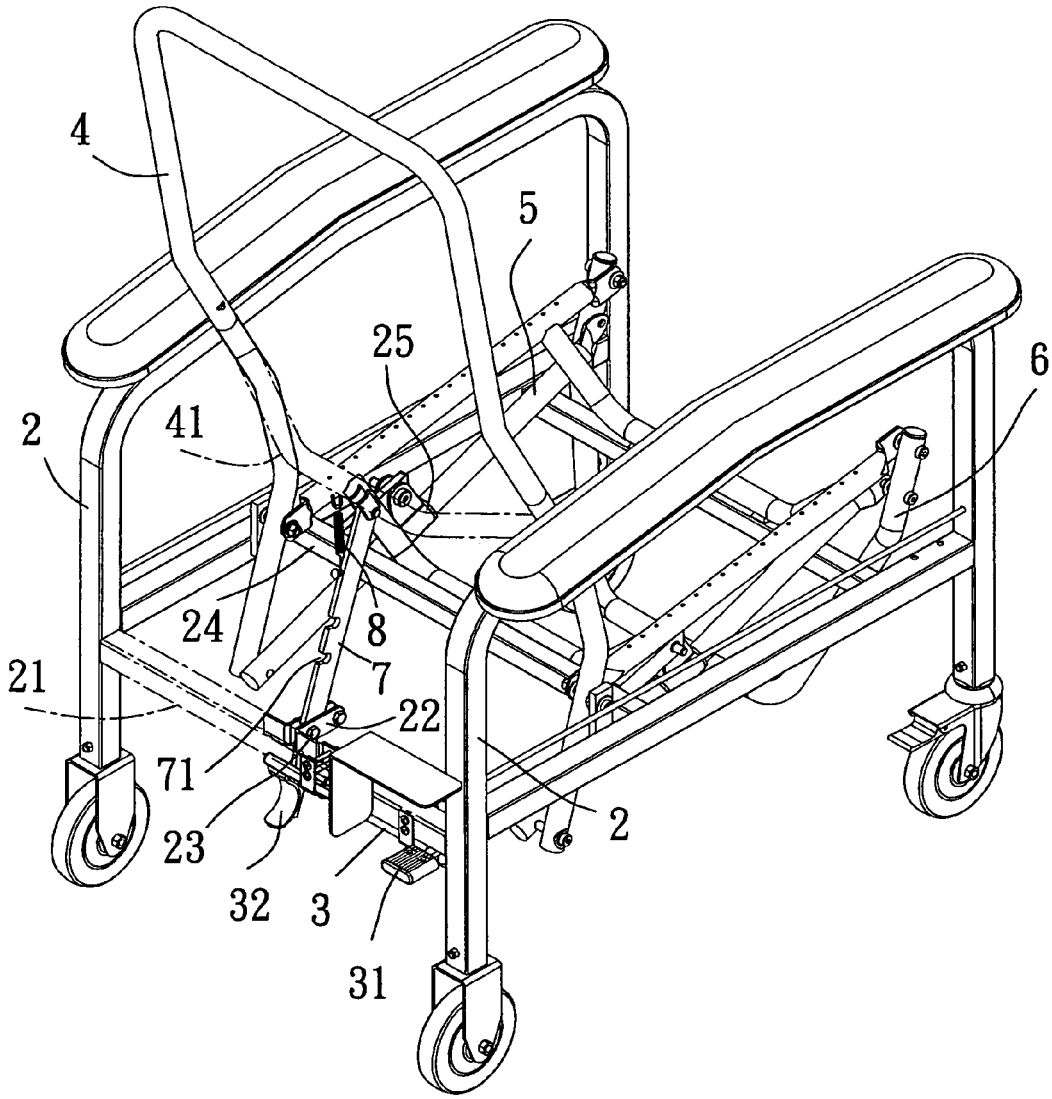
FIG. 2 is a perspective view of the reclining chair according to the present invention.
Figure 3:
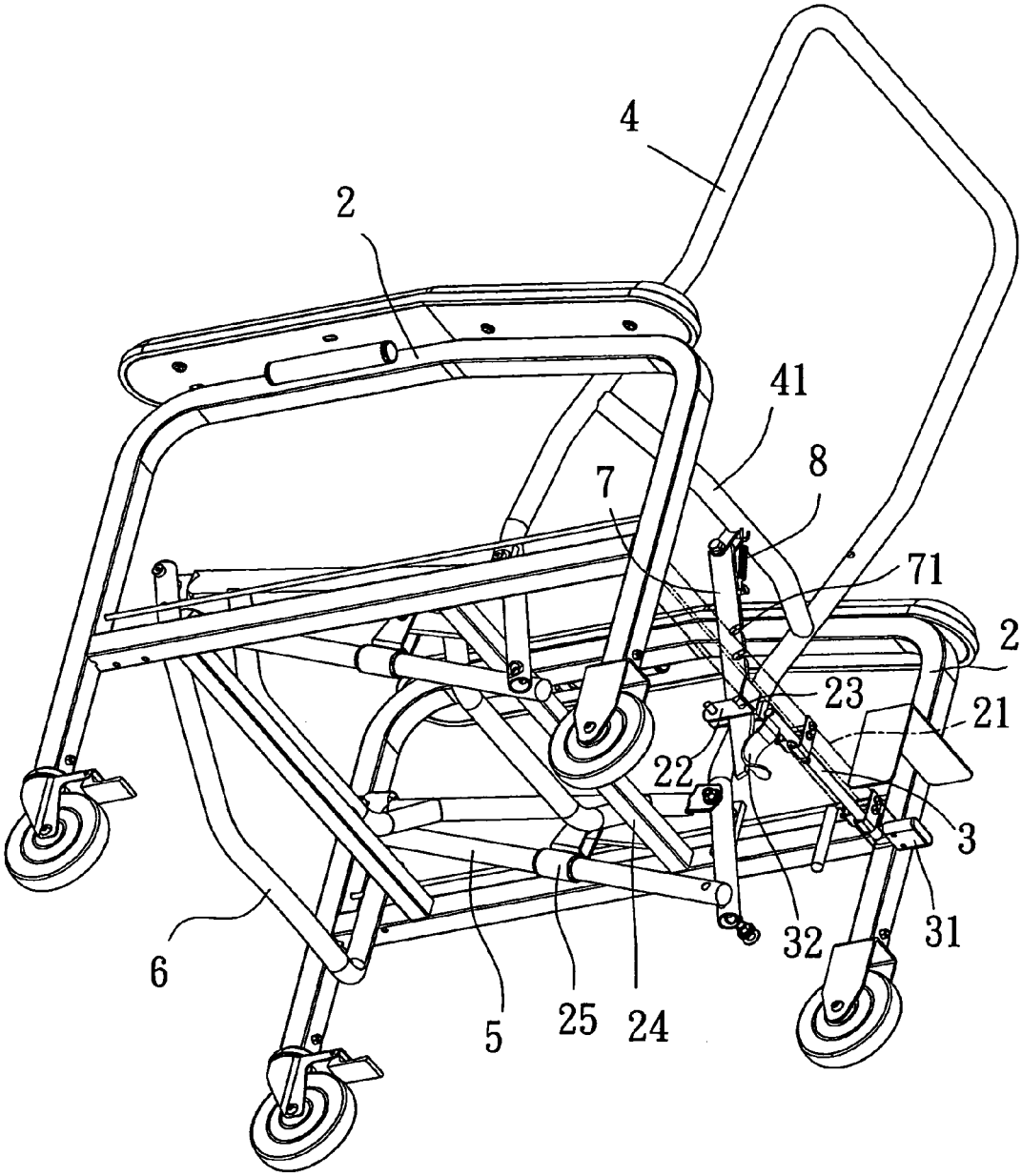
FIG. 3 is another perspective view of the reclining chair according to the present invention.
Figure 4:
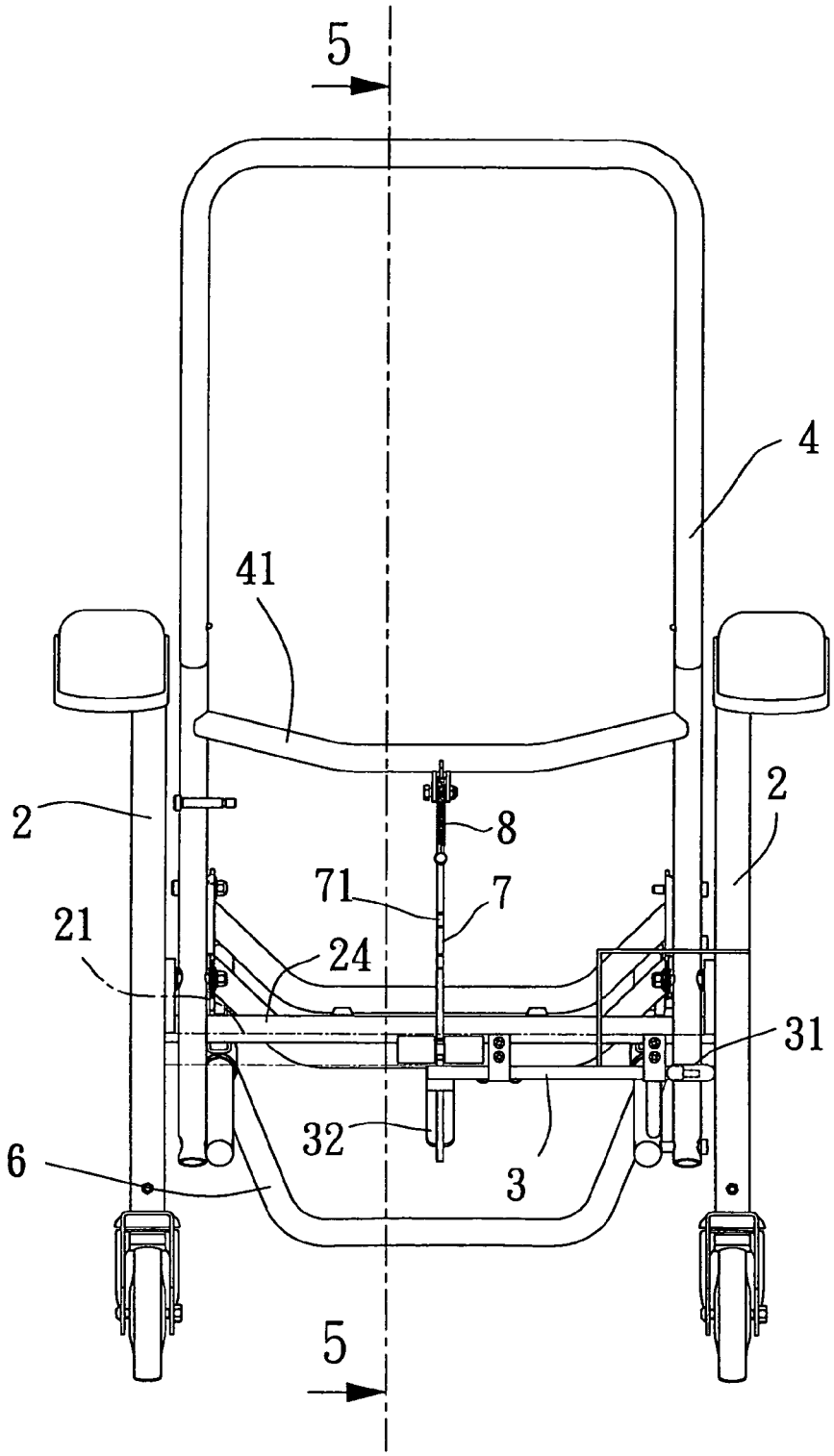
FIG. 4 is a rear view of the reclining chair of the present invention.

Referring to FIGS. 2 to 5, a preferred embodiment of a reclining chair in the present invention includes a support frame 2, a back 4, a footrest 6, a pair of connecting rods 5, and an adjusting mechanism for adjusting the back 4 as well as the footrest 6 with.

The support frame 2 has a first transverse rod 21 at a rear end, and a second transverse rod 24 a suitable distance from the first one 21.

The back 4 is pivoted to rear ends of two lateral parts of a fixed seat (not numbered) at substantially middle portions of two lateral parts thereof. The back 4 has a transverse support rod 41 connected with both of the lateral parts thereof.

The footrest 6 is pivoted to front ends of the lateral parts of the seat at upper ends of lateral portions thereof.

Figure 5:
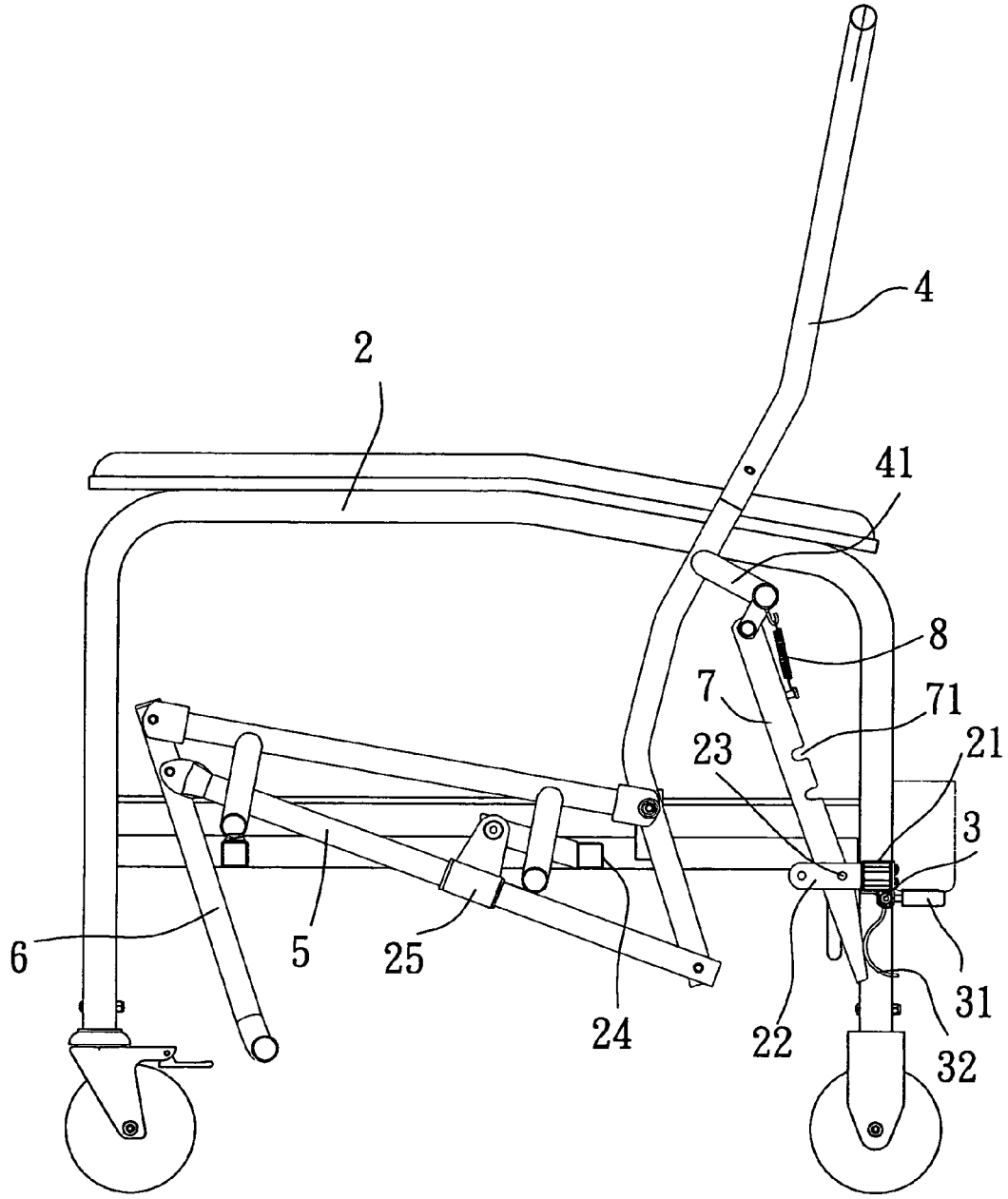
FIG. 5 is a side view of the reclining chair of the present invention.

The connecting rods 5 are pivoted to the footrest 6 at front ends, and pivoted to the lower ends of the lateral parts of the back 4 at rear ends thereof, as shown in FIG. 5. Furthermore, the connecting rods 5 are respectively passed through, and displaceable relative to short tubes 25, which are fixed on the second transverse rod 24 of the support frame 2. Thus, the footrest 6 will move together with the back 4; when the back 4 is moved towards a more reclined position, the footrest 6 will stretch towards the front at the same time, as shown in FIGS. 5 and 6 according to the present embodiment.

The adjusting mechanism is comprised of a rotary shaft 3 supported with the first transverse rod 21 of the support frame 2, a pedal 31 securely joined to one end of the rotary shaft 3, a pushing member 32 securely joined to the other end of the shaft 3, two separate plates 22 securely positioned right opposite each other on a front side of the first transverse rod 21 of the support frame 2, an engaging pin 23 joined to rear ends of the opposing plates 22 at two ends thereof, and a locking rod 7, which is pivoted to the transverse support rod 41 of the back 4 at an upper end thereof and passed through a space between the separate fixed plates 22 to be right opposite a front side of the pushing member 32 at a lower end thereof. The locking rod 7 is formed with several spaced engaging gaps 71 on a rear edge thereof. An elastic element 8 is connected with the transverse support rod 41 and the locking rod 7 at two ends thereof for biasing the locking rod 7 in such a way that the same can normally come into contact with the engaging pin 23 to engage the same 23 at the engaging gaps 71 thereof. The engaging pin 23 normally engage one of the gaps 71 of the locking rod 7, and in turns, both the back 4 and the footrest 6 are secured in position with the help of the locking rod 7 and the engaging pin 23. In addition, the pushing member 32 is preferably shaped to be like a half circle.

Figure 6:
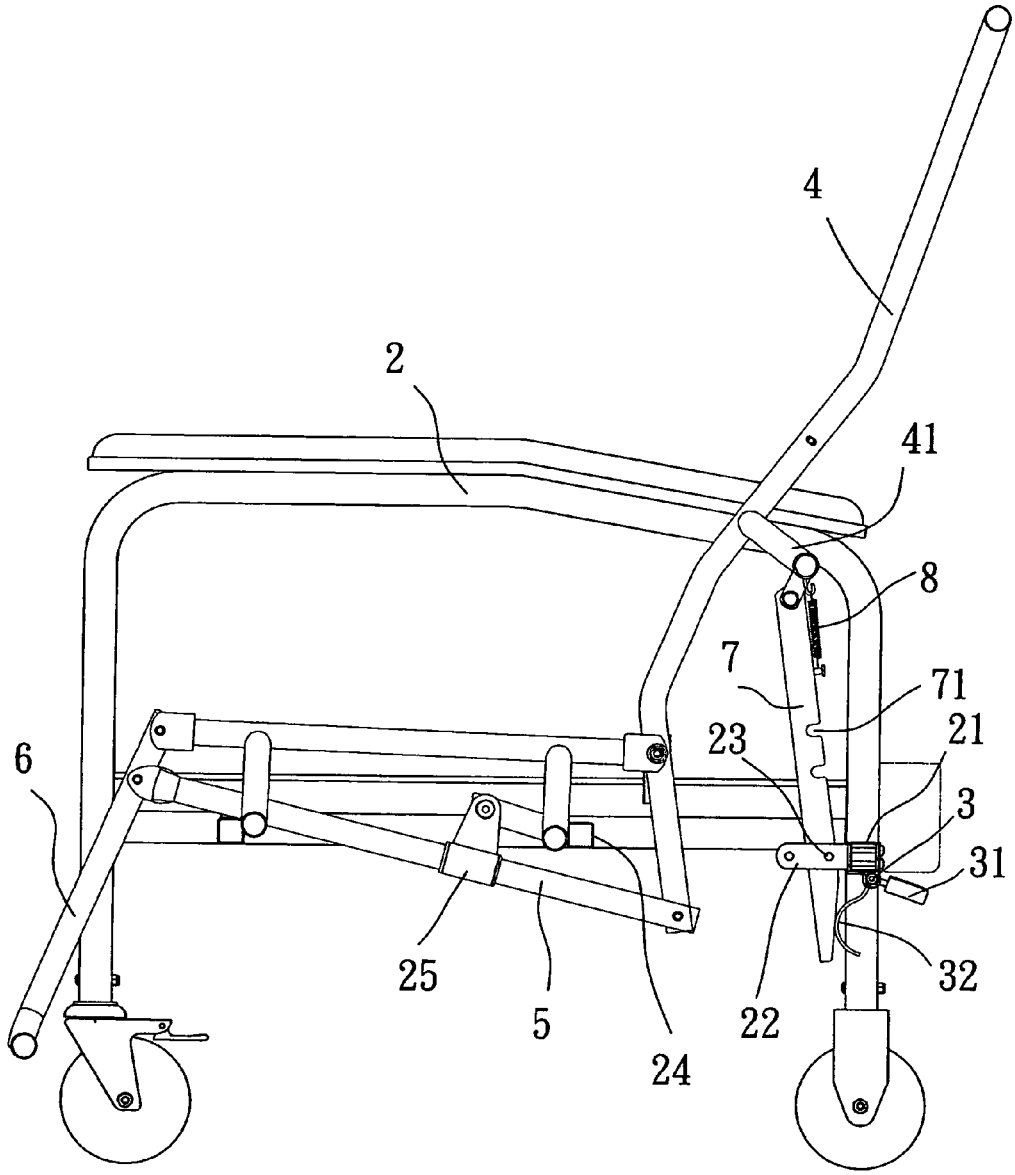
FIG. 6 is a side view of the reclining chair of the present invention under adjustment.

Referring to FIG. 6, to adjust the back 4 and the footrest 6, first the pedal 31 is depressed such that the pushing member 32 pushes the locking rod 7 forwards to make the same 7 disengage the engaging pin 23. Then, the back 4 is angularly displaced relative to the seat to an intended position, and the pedal 31 released such that the elastic element 8 makes the locking rod 7 engage the engaging pin 23 at another one of the engaging gaps 71 to secure the back 4 in position; when the back 4 is being adjusted, the footrest 6 will move at the same time in the way described above. In other words, the footrest 6 can be adjusted together with the back 4.

From the above description, it can be understood that the reclining chair of the present invention has advantages as followings:

1. The back can be moved to a selected one of several different positions thereof, and the footrest can, too. Therefore, the present reclining chair can satisfy different sitters' needs as well as satisfy one sitter in different situations.
2. When the back is being adjusted, the footrest will at the same time move to an appropriate position therefore the present reclining chair is better than the conventional one from ergonomic viewpoint.

What is claimed is:

1. An improvement on a reclining chair, comprising a support frame having a transverse rod at a rear end;

a back capable of being angularly displaced relative to a seat of the chair with a portion between two ends thereof being used as a pivot;

the back having a transverse support rod connected with both of the lateral rod parts thereof;

a footrest capable of being angularly displaced relative to the seat with an upper end thereof being used as a pivot;

a pair of connecting rods pivoted to the footrest at front ends, and pivoted to lower ends of the back at rear ends thereof for making the footrest movable together with the back;

a pair of tubes fixed on the support frame, and positioned around a respective one of the connecting rods such that the connecting rods are displaceable relative to them; and an adjusting mechanism for adjusting the back with; the adjusting mechanism including:

(1) a rotary shaft supported with the rear transverse rod of the support frame;

(2) a pedal securely joined to one end of the rotary shaft;

(3) a pushing member securely joined to other end of the rotary shaft;

(4) an engaging pin securely disposed in position;

(5) a locking rod for holding the back in position; the locking rod being pivoted to the transverse support rod of the back at an upper end thereof; the locking rod being right opposite a front side of the pushing member at a lower end thereof; the locking rod being formed with a plurality of spaced engaging gaps on a rear edge thereof for selective engagement with the engaging pin;

(6) an elastic element connected with the transverse support rod of the back and the locking rod at two ends thereof for biasing the locking rod in such a way that the locking rod can engage the engaging pin at the engaging gaps thereof; the back and the footrest being secured in position when the engaging pin is engaged with one of the gaps of the locking rod;

thereby allowing the back to be angularly displaced relative to the seat when the pedal is depressed for making the pushing member push the locking rod forwards such that the locking rod is disengaged from the engaging pin.

2. The reclining chair as claimed in claim 1, wherein the pushing member is shaped so as to be like a half circle.

3. The reclining chair as claimed in claim 1, wherein two separate plates are securely positioned right opposite each other on the transverse rod of the support frame, the engaging pin is joined to the separate plates at two ends thereof, and the locking rod is passed through a space between the separate plates.

* * * * *